US010121403B2

(12) United States Patent
Lu et al.

(10) Patent No.: US 10,121,403 B2
(45) Date of Patent: Nov. 6, 2018

(54) GATE TURN ON VOLTAGE COMPENSATING CIRCUIT, DISPLAY PANEL, DRIVING METHOD AND DISPLAY APPARATUS

(71) Applicants: BOE TECHNOLOGY GROUP CO., LTD., Beijing (CN); CHONGQING BOE OPTOELECTRONICS TECHNOLOGY CO., LTD., Beibei, Chongqing (CN)

(72) Inventors: Xu Lu, Beijing (CN); Yih Jen Hsu, Beijing (CN); Fei Shang, Beijing (CN); Haijun Qiu, Beijing (CN); Lijun Xiao, Beijing (CN); Shuai Hou, Beijing (CN)

(73) Assignees: BOE TECHNOLOGY GROUP CO., LTD., Beijing (CN); CHONGQING BOE OPTOELECTRONICS TECHNOLOGY CO., LTD., Chongqing (CN)

( * ) Notice: Subject to any disclaimer, the term of this patent is extended or adjusted under 35 U.S.C. 154(b) by 186 days.

(21) Appl. No.: 15/086,836

(22) Filed: Mar. 31, 2016

(65) Prior Publication Data

US 2017/0076657 A1 Mar. 16, 2017

(30) Foreign Application Priority Data

Sep. 15, 2015 (CN) ..... 2015 1 0584695

(51) Int. Cl.

| | |
|---|---|
| ***G09G 3/20*** | (2006.01) |
| *G09G 3/3225* | (2016.01) |
| *G09G 3/36* | (2006.01) |

(52) U.S. Cl.

CPC ..... *G09G 3/2007* (2013.01); *G09G 3/3225* (2013.01); *G09G 3/3648* (2013.01); (Continued)

(58) Field of Classification Search

CPC ..... G09G 3/2007; G09G 3/3677

(Continued)

(56) References Cited

U.S. PATENT DOCUMENTS

2004/0178983 A1* 9/2004 Tsai ..... G09G 3/3677 345/100

2012/0105405 A1 5/2012 Hsiao et al.

FOREIGN PATENT DOCUMENTS

CN 101029984 A 9/2007

CN 101226714 A 7/2008

(Continued)

OTHER PUBLICATIONS

First Chinese Office Action dated Apr. 21, 2017; Appln. No. 201510584695.7.

*Primary Examiner* — Fred Tzeng

(74) *Attorney, Agent, or Firm* — Ladas & Parry LLP; Loren K. Thompson

(57) ABSTRACT

The present disclosure provides a gate turn on voltage compensating circuit, a display panel, a driving method and a display apparatus thereof. The gate turn on voltage compensating circuit includes a voltage generation module, a clock control module and a chamfering module. The voltage generation module is used for correspondingly outputting generated first voltage signal and second voltage signal to a first voltage input terminal and a second voltage input terminal of the chamfering module; the clock control module is used for controlling the chamfering module to output corresponding chamfered voltage signals in the corresponding time periods, so that the chamfering depths of gate turn on voltage signals input correspondingly to respective gate drive chips in different time periods are different.

20 Claims, 6 Drawing Sheets

(52) U.S. Cl.
CPC ... *G09G 3/3696* (2013.01); *G09G 2300/0426* (2013.01); *G09G 2310/0267* (2013.01); *G09G 2310/066* (2013.01); *G09G 2310/067* (2013.01); *G09G 2330/028* (2013.01)

(58) Field of Classification Search
USPC ..... 345/213
See application file for complete search history.

(56) References Cited

FOREIGN PATENT DOCUMENTS

| | | | |
|---|---|---|---|
| CN | 101315749 | A | 12/2008 |
| CN | 101520998 | A | 9/2009 |
| CN | 101593496 | A | 12/2009 |
| CN | 101917179 | A | 12/2010 |
| CN | 201716968 | U | 1/2011 |
| CN | 102402959 | A | 4/2012 |
| CN | 103177703 | A | 6/2013 |

* cited by examiner

GATE TURN ON VOLTAGE COMPENSATING CIRCUIT, DISPLAY PANEL, DRIVING METHOD AND DISPLAY APPARATUS

TECHNICAL FIELD OF THE DISCLOSURE

The present disclosure relates to the field of display technology, and particularly to a gate turn on voltage compensating circuit, display panel, driving method and display apparatus thereof.

BACKGROUND

Today, display technology is applied widely in televisions, mobile phones as well as public information display. Flat panel displays for displaying pictures are widely popularized because of the advantage of being ultra-thin and energy saving. However, in most of flat panel displays, it is required to employ a gate drive chip to output a gate scan signal so as to control the display panel to implement functions of progressive scanning and frame-by-frame refreshing, thereby image data input to the display panel can be refreshed in real time, and thus the dynamical display can be achieved.

In order to implement the progressive scanning of the display panel, multiple gate drive chips are usually arranged in the peripheral area of the display panel to input gate turn on voltages to gate lines of the display area. As shown in FIG. 1, on one side, for example, the left side, of the peripheral area of the display panel, there are two gate drive chips GD1 and GD2. The gate turn on voltage is generated by a voltage generation module DC, and is then output to the cascaded gate drive chips GD1 and GD2 which output gate scan signals to gate lines of the display area sequentially under the control of a clock control module TCON, implementing the progressive scanning of the display panel. However, since the gate turn on voltage signal is transferred to the gate drive chip GD2 via the gate drive chip GD1, in the procedure of transfer, the trace impedance of the gate turn on voltage signal on the gate drive chip GD1 is inconsistent with that of the gate turn on voltage signal on the gate drive chip GD2 due to the long wiring length, making that the gate turn on voltage, i.e. the gate scan signal, output by the gate drive chip GD1 is different from the gate scan signal output by the gate drive chip GD2. Thus, the gate turn on voltages output by different gate drive chips differ from each other, resulting that the phenomenon of horizontal two split screen occurs, and the quality of the display screen is affected.

SUMMARY

Embodiments of the present disclosure provide a gate turn on voltage compensating circuit, display panel, driving method and display apparatus thereof for advancing the uniformity of gate turn on voltage signals output by respective gate drive chips in the display panel, thereby the phenomenon of horizontal two split screen is alleviated and the quality of the display screen is improved.

An embodiment of the present disclosure provides a gate turn on voltage compensating circuit, comprising a voltage generation module, a clock control module and a chamfering module.

The voltage generation module is used for generating a first voltage signal and a second voltage signal and correspondingly outputting, through a first voltage output terminal and a second voltage output terminal thereof, the generated first and second voltage signals to a first voltage input terminal and a second voltage input terminal of the chamfering module.

A first output terminal of the clock control module is connected with a first control terminal of the chamfering module, a second output terminal of the clock control module is connected with a second control terminal of the chamfering module, and the clock control module controls, through time sequence signals output via the first output terminal and the second output terminal thereof, the chamfering module to output corresponding chamfered gate turn on voltage signal in a corresponding time period.

According to the embodiment, the chamfering module chamfers the voltage signal generated by the voltage generation module at different times and with different depths, and then outputs the chamfered voltage signals, so that the gate turn on voltages correspondingly input to respective gate drive chips in different time periods are different. Since the gate turn on voltages reach gate drive chips of respective stages via wirings of different lengths, gate turn on voltages, i.e. gate scan signals, finally output to respective gate lines by the respective gate drive chips may be relatively uniform. For example, since respective gate drive chips in the display panel are connected in cascade, a shallowly-chamfered voltage may be input to the gate drive chip of a first stage; since the wiring for the gate turn on voltage signal in the gate drive chip of a second stage is longer, the chamfering depth of the gate turn on voltage signal input to the gate drive chip of the second stage is increased. Therefore, gate turn on voltage signals of different chamfering depths reach gate drive chips of respective stages via wirings of different lengths, and finally gate turn on voltage signals, i.e. gate scan signals, output by respective gate drive chips are relatively uniform, thus alleviating the phenomenon of horizontal two split screen and improving the quality of the display screen. The above embodiment is also applicable to a case that the display panel contains cascaded gate drive chips of N stages (N>2). Specifically, the gate drive chips of N stages may be divided into two groups, shallowly-chamfered voltages are input to gate drive chips of former m stages which are closer to the gate turn on voltage compensating circuit, and the gate turn on voltage signals of increased depths are input to gate drive chips of remaining stages. In this way, gate turn on voltage signals of different chamfering depths reach different gate drive chips via wirings of different lengths and finally gate turn on voltage signals output by respective gate drive chips are relatively uniform, thus alleviating the phenomenon of horizontal two split screen and improving the quality of the display screen.

In one possible implementation, in the above gate turn on voltage compensating circuit provided by the embodiment of the present disclosure, the chamfering module comprises a chamfering time control unit, a chamfering depth control unit and an output control unit.

A first control terminal of the chamfering time control unit is connected with the first output terminal of the clock control module, a second control terminal thereof is connected with a reference voltage terminal, a first input terminal thereof is connected with the second voltage output terminal of the voltage generation module, a second input terminal thereof is connected with a ground signal terminal, and an output terminal thereof is connected with a first control terminal and a first input terminal of the output control unit respectively, and the chamfering time control unit is used for controlling the chamfering time for outputting the chamfered gate turn on voltage signal under the control of the first output terminal of the clock control module and the reference voltage terminal.

A first control terminal of the chamfering depth control unit is connected with the second output terminal of the clock control module, a second control terminal thereof is connected with the reference voltage terminal, a first input terminal thereof is connected with the first voltage output terminal of the voltage generation module, a second input terminal thereof is connected with the ground signal terminal, and an output terminal thereof with a second input terminal of the output control unit, and the chamfering depth control unit is used for outputting the chamfered gate turn on voltage signals of different chamfering depths under the control of the second output terminal of the clock control module and the reference voltage terminal.

A second control terminal of the output control unit is connected with the first voltage output terminal of the voltage generation module, a third input terminal thereof is connected with the ground signal terminal, and an output terminal thereof is connected with a gate turn on voltage input terminal, and the output control unit is used for selecting, through the gate turn on voltage input terminal, to output the second voltage signal generated by the voltage generation module or the chamfered gate turn on voltage signal under the control of the output terminal of the chamfering time control unit and the first voltage output terminal of the voltage generation module.

In one possible implementation, in the above gate turn on voltage compensating circuit provided by the embodiment of the present disclosure, the chamfering time control unit comprises a first comparator, a first switching transistor, a second switching transistor and a first resistor.

A first input terminal of the first comparator is connected with the first output terminal of the clock control module, a second input terminal thereof is connected with the reference voltage terminal, and an output terminal thereof is connected with a gate of the first switching transistor and a gate of the second switching transistor, respectively.

A source of the first switching transistor is connected with the second voltage output terminal of the voltage generation module, a drain thereof is connected with a drain of the second switching transistor and the first input terminal of the output control unit, respectively.

A source of the second switching transistor is connected with one end of the first resistor.

The other end of the first resistor is connected with the ground signal terminal.

In one possible implementation, in the above gate turn on voltage compensating circuit provided by the embodiment of the present disclosure, the first switching transistor is an N-type transistor, and the second switching transistor is a P-type transistor.

In one possible implementation, in the above gate turn on voltage compensating circuit provided by the embodiment of the present disclosure, the output control unit comprises a second comparator, a third switching transistor, a fourth switching transistor and a storage capacitor.

A first input terminal of the second comparator is connected with the output terminal of the chamfering time control unit and a source of the third switching transistor respectively, a second input terminal thereof is connected with the first voltage output terminal of the voltage generation module, and an output terminal thereof is connected with a gate of the third switching transistor and a gate of the fourth switching transistor, respectively.

A drain of the third switching transistor is connected with the gate turn on voltage input terminal.

A source of the fourth switching transistor is connected with the output terminal of the chamfering depth control unit, and a drain thereof is connected with the gate turn on voltage input terminal.

The storage capacitor is connected between the ground signal terminal and the gate turn on voltage input terminal.

In one possible implementation, in the above gate turn on voltage compensating circuit provided by the embodiment of the present disclosure, the third switching transistor is an N-type transistor, and the fourth switching transistor is a P-type transistor.

In one possible implementation, in the above gate turn on voltage compensating circuit provided by the embodiment of the present disclosure, the chamfering depth control unit comprises a second resistor, a third resistor, a third comparator, a fifth switching transistor, a sixth switching transistor and a fourth resistor.

One end of the second resistor is connected with the first voltage output terminal of the voltage generation module, and the other end thereof is connected with one end of the third resistor and a source of the fifth switching transistor, respectively.

The other end of the third resistor is connected with the ground signal terminal.

A first input terminal of the third comparator is connected with the second output terminal of the clock control module, a second input terminal thereof is connected with the reference voltage terminal, and an output terminal thereof is connected with a gate of the fifth switching transistor and a gate of the sixth switching transistor, respectively.

A drain of the fifth switching transistor is connected with a drain of the sixth switching transistor and the second input terminal of the output control unit, respectively.

A source of the sixth switching transistor is connected with one end of the fourth resistor.

The other end of the fourth resistor is connected with the ground signal terminal.

In one possible implementation, in the above gate turn on voltage compensating circuit provided by the embodiment of the present disclosure, the fifth switching transistor is an N-type transistor, and the sixth switching transistor is a P-type transistor.

In one possible implementation, in the above gate turn on voltage compensating circuit provided by the embodiment of the present disclosure, the gate turn on voltage compensating circuit is arranged on a printed circuit board.

An embodiment of the present disclosure provides a display panel comprising a plurality of gate lines located in a display area, a plurality of gate drive chips for inputting gate turn on voltage signals to the gate lines, and the gate turn on voltage compensating circuit provided by the above embodiment of the present disclosure. The gate drive chips are connected in cascade, and the gate turn on voltage compensating circuit is used for inputting the corresponding chamfered gate turn on voltage signal to the gate drive chip of a first stage at the chamfering time.

In one possible implementation, in the display panel provided by the above embodiment of the present disclosure, the plurality of gate drive chips forms two groups of gate drive chips which are symmetrically distributed at two terminals of the gate lines, and the gate drive chip of the last stage in the first group of gate drive chips and the gate drive chip of the last stage in the second group of gate drive chips are connected in cascade. The gate turn on voltage compensating circuit is used for inputting the corresponding chamfered gate turn on voltage signal to the gate drive chip of the first stage in the first group of gate drive chips at the chamfering time.

An embodiment of the present disclosure provides a driving method of the display panel provided by the above embodiment of the present disclosure, comprising: within the display time of one frame, inputting, by the gate turn on voltage compensating circuit, shallowly-chamfered gate turn on voltage signals to gate drive chips of former m stages in the plurality of gate drive chips connected in cascade, and inputting deeply-chamfered gate turn on voltage signals to gate drive chips of remaining stages.

An embodiment of the present disclosure provides a display apparatus comprising the display panel provided by the above embodiment of the present disclosure.

DETAILED DESCRIPTION

In the following, a gate turn on voltage compensating circuit, a display panel, a driving method and a display apparatus thereof provided by embodiments of the present disclosure are explained in detail in conjunction with attached drawings.

Figure 1:
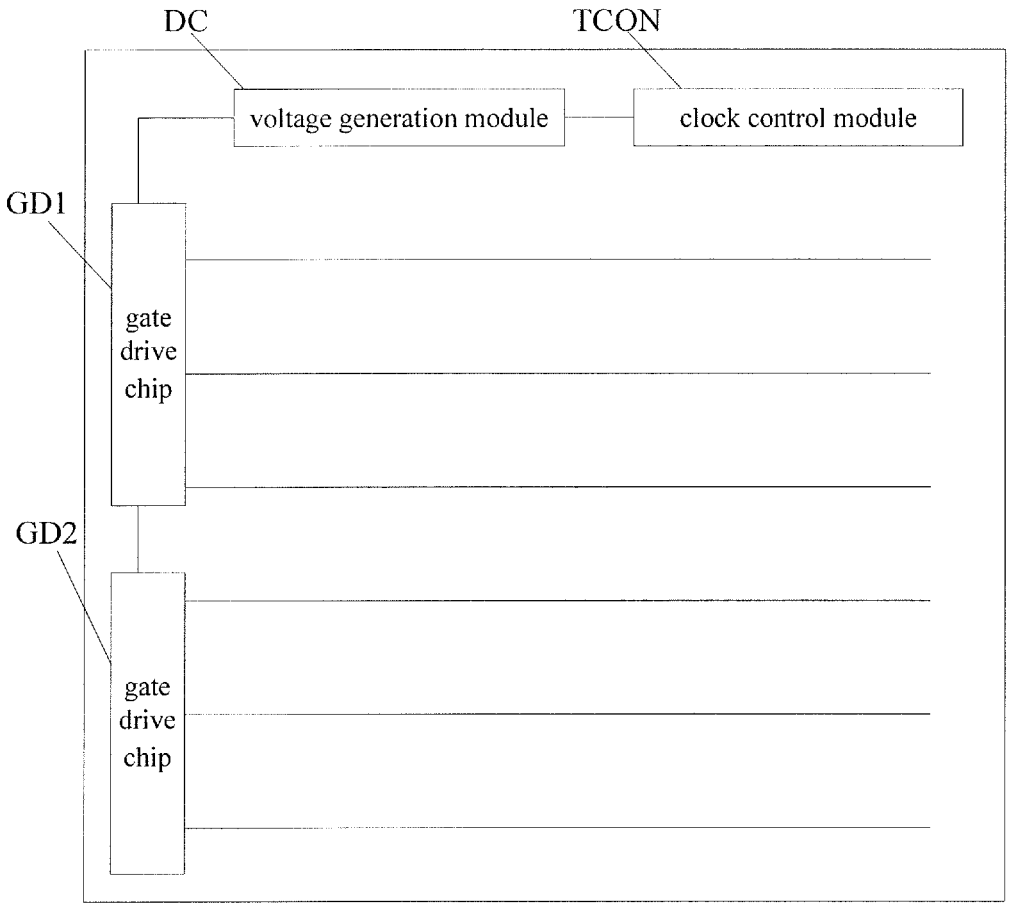
FIG. 1 is a schematic structure diagram of a display panel in the prior art.
Figure 2:
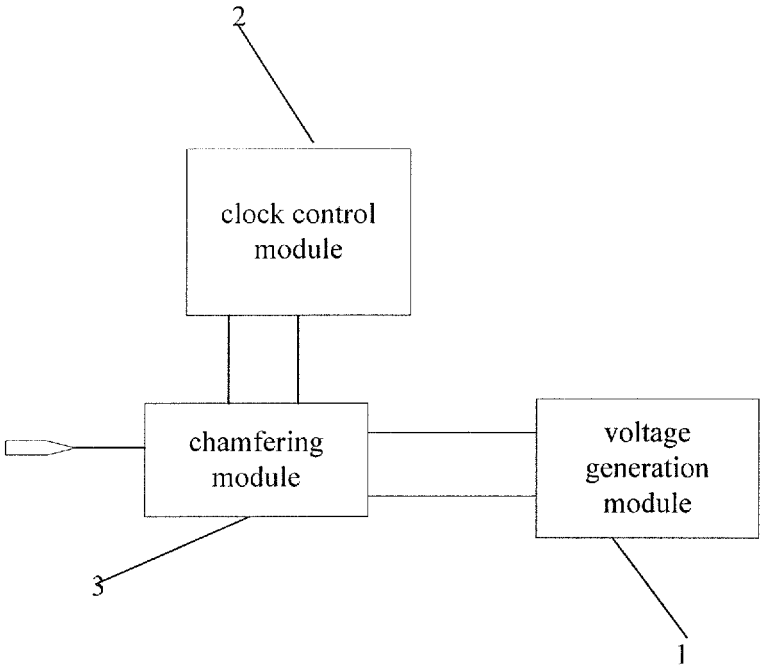
FIG. 2 is a schematic structure diagram of a gate turn on voltage compensating circuit provided by an embodiment of the present disclosure.

An embodiment of the present disclosure provides a gate turn on voltage compensating circuit, as shown in FIG. 2, which may includes a voltage generation module 1, a clock control module 2 and a chamfering module 3.

A first voltage output terminal of the voltage generation module 1 is connected with a first voltage input terminal of the chamfering module 3, and a second voltage output terminal of the voltage generation module 1 is connected with a second voltage input terminal of the chamfering module 3. The voltage generation module 1 is used for generating a first voltage signal and a second voltage signal, and correspondingly outputting, through the first voltage output terminal and the second voltage output terminal thereof, the generated first and second voltage signals to the first voltage input terminal and the second voltage input terminal of the chamfering module 3.

A first output terminal of the clock control module 2 is connected with a first control terminal of the chamfering module 3, a second output terminal of the clock control module 2 is connected with a second control terminal of the chamfering module 3, and the clock control module 2 controls, through time sequence signals output via the first output terminal and the second output terminal thereof, the chamfering module 3 to output corresponding chamfered gate turn on voltage signal in the corresponding time period.

According to the above gate turn on voltage compensating circuit provided by the embodiment of the present disclosure, the chamfering module chamfers the voltage signal generated by the voltage generation module at different times and with different depths, and then outputs the chamfered voltage signals, so that the gate turn on voltages correspondingly input to respective gate drive chips in different time periods are different. Since the gate turn on voltages reach gate drive chips of respective stages via wirings of different lengths, gate turn on voltages, i.e. gate scan signals, finally output to respective gate lines by the respective gate drive chips may be relatively uniform. For example, since respective gate drive chips in the display panel are connected in cascade, a shallowly-chamfered voltage may be input to the gate drive chip of a first stage; since the wiring for the gate turn on voltage signal in the gate drive chip of a second stage is longer, the chamfering depth of the gate turn on voltage signal input to the gate drive chip of the second stage is increased. Therefore, gate turn on voltage signals of different chamfering depths reach gate drive chips of respective stages via wirings of different lengths, and finally gate turn on voltage signals, i.e. gate scan signals, output by respective gate drive chips are relatively uniform, thus alleviating the phenomenon of horizontal two split screen and improving the quality of the display screen. The gate turn on voltage compensating circuit of the above embodiment is also applicable to a case that the display panel contains cascaded gate drive chips of N stages (N>2). Specifically, the gate drive chips of N stages may be divided into two groups, shallowly-chamfered voltages are input to gate drive chips of former m stages which are closer to the gate turn on voltage compensating circuit, and the gate turn on voltage signals of increased depths are input to gate drive chips of remaining stages. In this way, gate turn on voltage signals of different chamfering depths reach different gate drive chips via wirings of different lengths and finally gate turn on voltage signals output by respective gate drive chips are relatively uniform, thus alleviating the phenomenon of horizontal two split screen and improving the quality of the display screen.

Figure 3:
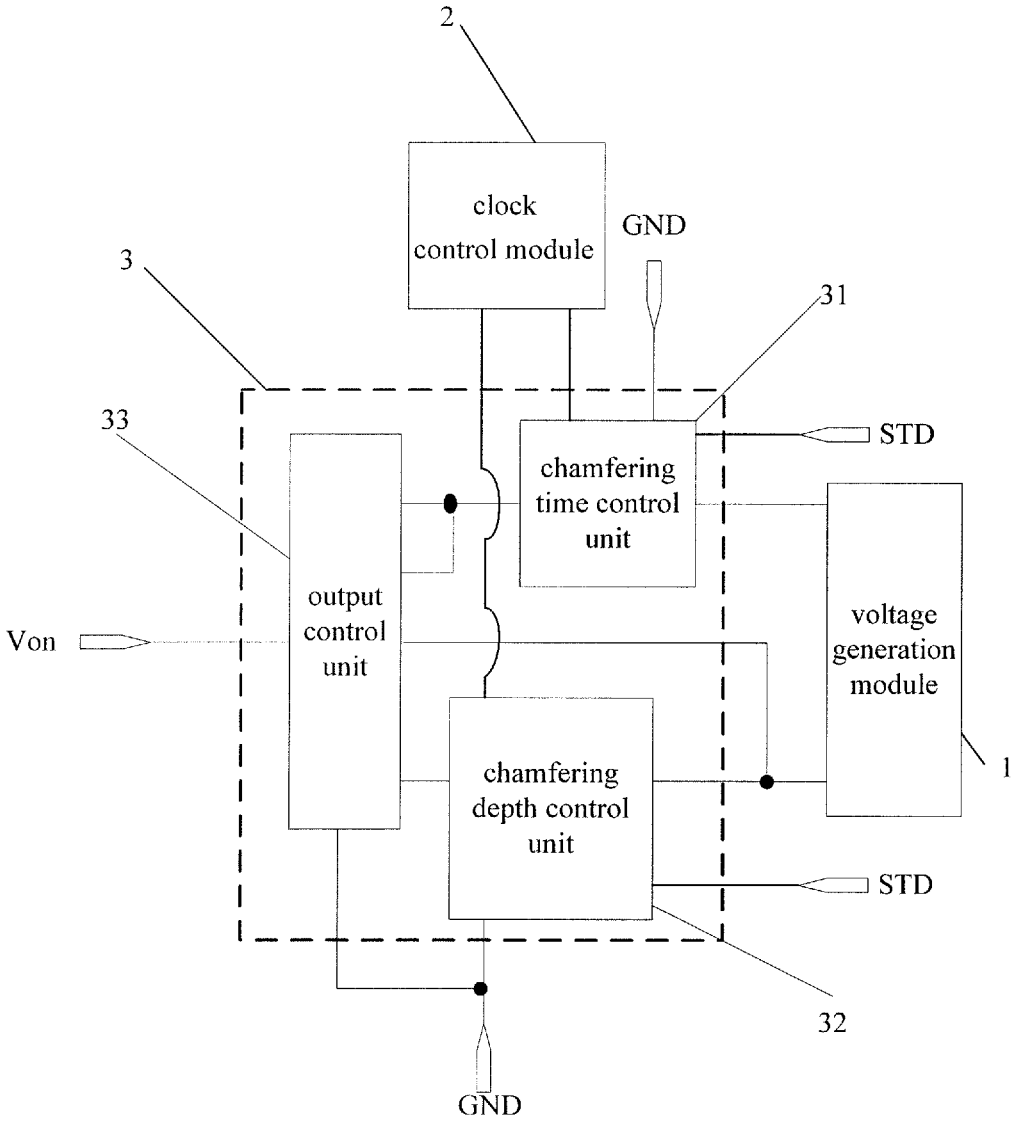
FIG. 3 is a schematic structure diagram of the of an chamfering module provided by an embodiment of the present disclosure.

In a specific implementation, in the above gate turn on voltage compensating circuit provided by the embodiment of the present disclosure, as shown in FIG. 3, the chamfering module 3 may specifically includes a chamfering time control unit 31, a chamfering depth control unit 32 and an output control unit 33.

A first control terminal of the chamfering time control unit 31 (the first control terminal of the chamfering time control unit is the same as the first control terminal of the chamfering module) is connected with the first output terminal of the clock control module 2, a second control terminal of the chamfering time control unit 31 is connected with a reference voltage terminal STD, a first input terminal thereof is connected with the second voltage output terminal of the voltage generation module 1, a second input terminal thereof if connected with a ground signal terminal GND, and an output terminal thereof is connected with the first control terminal and the first input terminal of the output control unit 33, respectively. The chamfering time control unit 31 is used for controlling the chamfering time for outputting the chamfered gate turn on voltage signal under the control of the first output terminal of the clock control module 2 and the reference voltage terminal STD.

A first control terminal of the chamfering depth control unit 32 (the first control terminal of the chamfering depth control unit is the same as the second control terminal of the chamfering module) is connected with the second output terminal of the clock control module 2, a second control terminal of the chamfering depth control unit 32 is connected with the reference voltage terminal STD, a first input terminal thereof is connected with the first voltage output terminal of the voltage generation module 1, a second input terminal thereof is connected with the ground signal terminal GND, and an output terminal thereof is connected with the second input terminal of the output control unit 33, and the chamfering depth control unit 32 is used for outputting the chamfered voltages of different chamfering depths under the control of the second output terminal of the clock control module 2 and the reference voltage terminal STD.

A second control terminal of the output control unit 33 is connected with the first voltage output terminal of the voltage generation module 1, a third input terminal thereof is connected with the ground signal terminal GND, and an output terminal thereof is connected with a gate turn on voltage input terminal Von, and the output control unit 33 is used for selecting, through the gate turn on voltage input terminal Von, to output the second voltage signal generated by the voltage generation module 1 or the chamfered gate turn on voltage signal under the control of the output terminal of the chamfering time control unit 31 and the first voltage output terminal of the voltage generation module 1.

According to the above gate turn on voltage compensating circuit provided by the embodiment of the present disclosure, the chamfering module may generate different chamfer voltages in corresponding time periods through the chamfering time control unit 31 and the chamfering depth control unit 32, the output control unit may then select to output the second voltage signal generated by the voltage generation module 1 or the chamfered voltage signal through the gate turn on voltage input terminal Von. That is, depending on the lengths of the wirings required by the gate-open signals on respective gate drive chips on the display panel, the chamfering module may select, through the gate turn on voltage input terminal Von, to output the second voltage signal generated by the voltage generation module 1 or the chamfered voltage signal to the corresponding gate drive chip, thereby gate turn on voltage signals, i.e. gate scan signals, output by respective gate drive chips terminal tend to be uniform after passing through wirings of different lengths, thus alleviating the phenomenon of horizontal two slip screen and improving the quality of the display screen.

Figure 4:
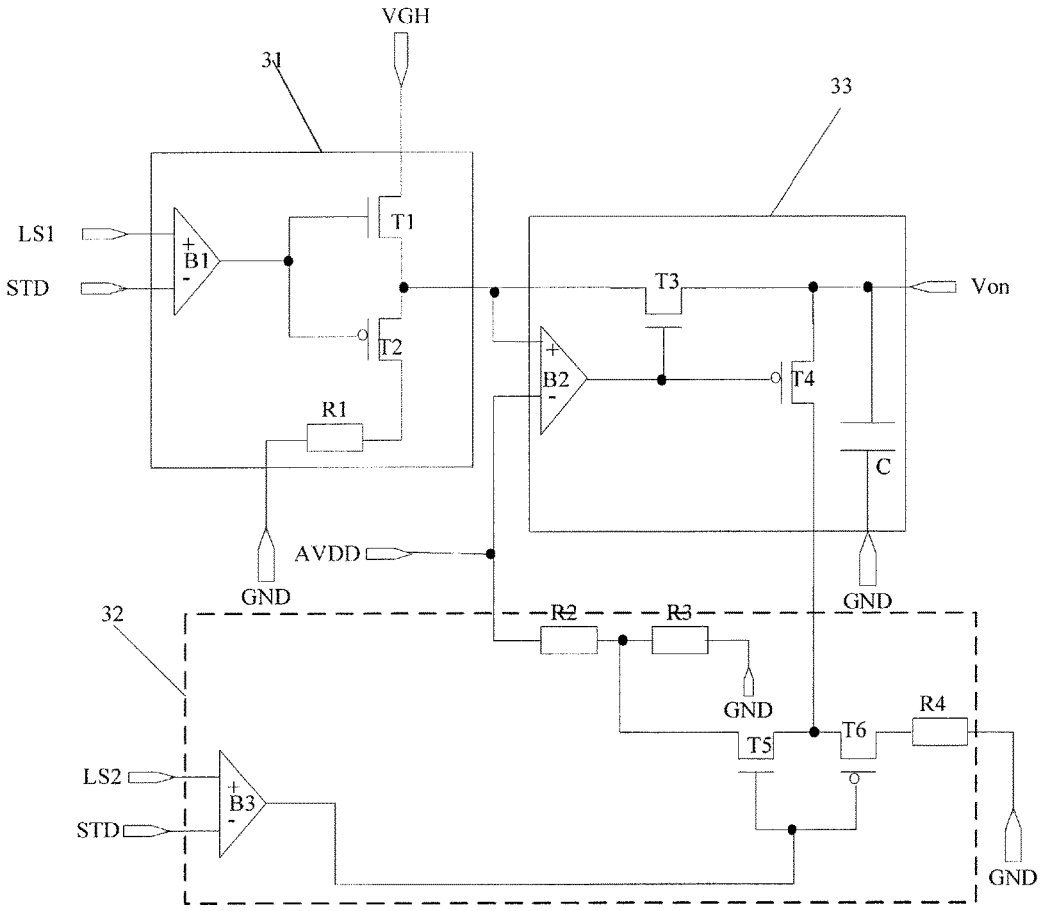
FIG. 4 is a schematic diagram of the specific circuit structure of the chamfering module provided by the embodiment of the present disclosure.

In a specific implementation, in the above gate turn on voltage compensating circuit provided by the embodiment of the present disclosure, as shown in FIG. 4, the chamfering time control unit may specifically includes a first comparator B1, a first switching transistor T1, a second switching transistor T2 and a first resistor R1.

A first input terminal of the first comparator B1 is connected with the first output terminal LS1 of the clock control module, a second input terminal of the first comparator B1 is connected with the reference voltage terminal STD, and an output terminal of B1 is connected with a gate of the first switching transistor T1 and a gate of the second switching transistor T2, respectively.

A source of the first switching transistor T1 is connected with the second voltage output terminal of the voltage generation module, a drain of T1 is connected with a drain of the second switching transistor T2 and the first input terminal of the output control unit, respectively.

A source of the second switching transistor T2 is connected with one end of the first resistor R1.

The other end of the first resistor R1 is connected with the ground signal terminal GND.

Specifically, in the above gate turn on voltage compensating circuit provided by the embodiment of the present disclosure, when the first output terminal LS1 of the clock control module outputs a high-level signal, the first comparator B1 outputs a high-level signal, and then the first switching transistor T1 is in a turn-on state. At this time, the turn-on first switching transistor T1 connects the second voltage output terminal of the voltage generation module with the first input terminal of the output control unit, that is, transfers the second voltage signal VGH output by the second voltage output terminal of the voltage generation module to the first input terminal of the output control unit. When the first output terminal LS1 of the clock control module outputs a low-level signal, the first comparator B1 outputs a low-level signal, and then the second switching transistor T2 is in a turn-on state. At this time, the turn-on second switching transistor T2 connects one end of the first resistor R1 with the first input terminal of the output control unit, that is, a ground signal is transferred to the first input terminal of the output control unit via the first resistor R1 and the turn-on second switching transistor T2. Furthermore, it is to be noted that, the time sequence scan signal output by the first output terminal LS1 of the clock control module is consistent with gate scan time sequence, and the chamfering time may be controlled by the duty ratio of the time sequence scan signal output by the first output terminal LS1 of the clock control module.

In a specific implementation, in the above gate turn on voltage compensating circuit provided by the embodiment of the present disclosure, as shown in FIG. 4, the output control unit may specifically includes a second comparator B2, a third switching transistor T3, a fourth switching transistor T4 and a storage capacitor C.

A first input terminal of the second comparator B2 is connected with the output terminal of the chamfering time control unit 31 and a source of the third switching transistor T3 respectively, a second input terminal of B2 is connected with the first voltage output terminal AVDD of the voltage generation module, and an output terminal of B2 is connected with a gate of the third switching transistor T3 and a gate of the fourth switching transistor T4, respectively.

A drain of the third switching transistor T3 is connected with the gate turn on voltage input terminal Von.

A source of the fourth switching transistor T4 is connected with the output terminal of the chamfering depth control unit 32, and a drain thereof is connected with the gate turn on voltage input terminal Von.

The storage capacitor C is connected between the ground signal terminal GND and the gate turn on voltage input terminal Von.

Specifically, in the above gate turn on voltage compensating circuit provided by the embodiment of the present disclosure, when the first output terminal LS1 of the clock control module outputs a high-level signal, the output terminal of the chamfering time control unit 31 outputs a high-level signal VGH to the first input terminal of the output control unit 33, i.e. the first input terminal of the second comparator B2. At this time, the second comparator B2 outputs a high-level signal, and then the third switching transistor T3 is turned on. The turn-on third switching transistor T3 transfers the high-level signal VGH to the gate turn on voltage input terminal Von, and the high-level signal VGH is then output to the gate drive chip on the display panel. When the first output terminal LS1 of the clock control module outputs a low-level signal, the output terminal of the chamfering time control unit 31 outputs a ground signal to the first input terminal of the output control unit 33, i.e. the first input terminal of the second comparator B2. At this time, the second comparator B2 outputs a low-level signal, and then the fourth switching transistor T4 is turned on. The turn-on fourth switching transistor T4 transfers the chamfered voltage output by the chamfering depth control unit 32 to the gate turn on voltage input terminal Von, and the chamfered voltage is then output to the gate drive chip on the display panel. Thus, the chamfering module may select to output the second voltage signal generated by the voltage generation module or the chamfered voltage signal in the corresponding time periods.

In a specific implementation, in the above gate turn on voltage compensating circuit provided by the embodiment of the present disclosure, as shown in FIG. 4, the chamfering depth control unit 32 may specifically includes a second resistor R2, a third resistor R3, a third comparator B3, a fifth switching transistor T5, a sixth switching transistor T6 and a fourth resistor R4.

One end of the second resistor R2 is connected with the first voltage output terminal of the voltage generation module 1, and the other end of the second resistor R2 is connected with one end of the third resistor R3 and a source of the fifth switching transistor T5, respectively.

The other end of the third resistor R3 is connected with the ground signal terminal GND.

A first input terminal of the third comparator B3 is connected with the second output terminal of the clock control module 2, a second input terminal of B3 is connected with the reference voltage terminal STD, and an output terminal of B3 is connected with a gate of the fifth switching transistor T5 and a gate of the sixth switching transistor T6, respectively.

A drain of the fifth switching transistor T5 is connected with a drain of the sixth switching transistor T6 and the second input terminal of the output control unit 33, respectively.

A source of the sixth switching transistor T6 is connected with one end of the fourth resistor R4.

The other end of the fourth resistor R4 is connected with the ground signal terminal GND.

Specifically, in the above gate turn on voltage compensating circuit provided by the embodiment of the present disclosure, when the second output terminal LS2 of the clock control module outputs a high-level signal, the third comparator B3 outputs a high-level signal, then the fifth switching transistor T5 is in a turn-on state. The voltage signal AVDD output by the first voltage output terminal of the voltage generation module is subject to voltage division by the second resistor R2 and the third resistor R3, so that the voltage at the source of the fifth switching transistor T5 is the voltage at a point between the second resistor R2 and the third resistor R3, and the value thereof is specifically decided by a ratio of the resistance value of the second resistor R2 and the resistance value of the third resistor R3. For example, if the resistance value of the second resistor R2 is the same at that of the third resistor R3, the voltage at the source of the fifth switching transistor T5 is half of AVDD. Thus, the turn-on fifth switching transistor T5 transfers the voltage signal at the source thereof to the second input terminal of the output control unit 33. When the second output terminal LS2 of the clock control module outputs a low-level signal, the third comparator B3 outputs a low-level signal, the sixth switching transistor T6 is then in a turn-on state. At this time, the storage capacitor C of the output control unit 33 is discharged to the ground via the turn-on sixth switching transistor T6, so that the gate turn on voltage input terminal Von outputs a deeply-chamfered voltage signal. It can be seen, when the second output terminal LS2 of the clock control module outputs a high-level signal, the gate turn on voltage input terminal Von outputs a shallowly-chamfered voltage signal with the chamfering depth being controlled to be the voltage value at the point between R2 and R3; when the second output terminal LS2 of the clock control module outputs a low-level signal, the gate turn on voltage input terminal Von outputs a deeply-chamfered voltage signal with the chamfering depth being pulled down to be close to GND. Thus, the chamfering depth may be controlled by controlling the level of the time sequence scan signal output by the second output terminal LS2 of the clock control module to be high or low.

In a specific implementation, the above gate turn on voltage compensating circuit provided by the embodiment of the present disclosure may be arranged on a printed circuit board, and thus may be bound to the display panel in synchronization with the gate drive chips, and provide control signals such as a power supply voltage signal, a gate drive scan signal, a clock signal and so on for driving the display panel to perform the image display.

Figure 5:
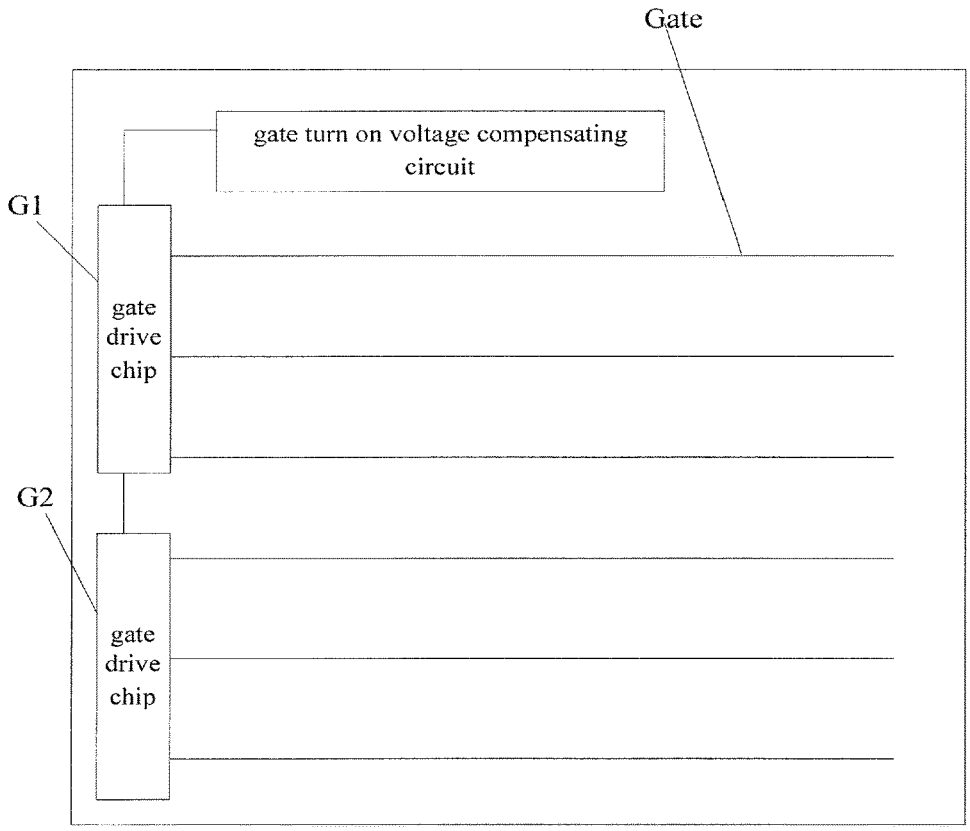
FIG. 5 is a first schematic structure diagram of a display panel provided by an embodiment of the present disclosure.

Based on the same inventive concept, an embodiment of the present disclosure provides a display panel, as shown in FIG. 5, which includes a plurality of gate lines Gates located in a display area, a plurality of gate drive chips G1 and G2 for inputting gate turn on voltage signals to the gate lines Gates, and the gate turn on voltage compensating circuit provided by the above embodiment of the present disclosure.

The gate drive chips are connected in cascade.

The gate turn on voltage compensating circuit is used for inputting the corresponding chamfered gate turn on voltage signal to the gate drive chip G1 of a first stage at the chamfering time.

Specifically, in the above display panel provided by the embodiment of the present disclosure, as shown in FIG. 5, for example, the display panel has two gate drive chips G1 and G2 arranged in the peripheral area, the two gate drive chips being connected in cascade. The gate turn on voltage compensating circuit outputs a gate turn on voltage signal to an input terminal of the gate drive chip G1 of the first stage. In this way, in order to realize the progressive scan of the display panel, the gate drive chips G1 and G2 sequentially input gate scan signals to corresponding gate lines Gates in accordance with the corresponding time sequence control. Since the gate turn on voltage signals input to the gate drive chip G1 and the gate drive chip G2 need wirings of different lengths, the gate turn on voltage compensating circuit outputs a shallowly-chamfered gate turn on voltage signal in the scan procedure of the gate drive chip G1, while the gate turn on voltage compensating circuit output a deeply-chamfered gate turn on voltage signal in the scan procedure of the gate drive chip G2. In this way, gate turn on voltage signals input to two gate drive chips have different chamfers, and pass through wirings of different lengths, thus the magnitudes of gate scan signals output finally by the gate drive chip G1 and the gate drive chip G2 tend to be uniform. Thus, the phenomenon of horizontal two split screen is alleviated and the quality of the display screen is improved.

It is noted that, the switching transistors mentioned in the above embodiments of the present disclosure may be Thin Film Transistors (TFTs), or may be Metal Oxide Semiconductors (MOSs), and are not limited herein. In the specific implementation, sources and drains of these transistors may be exchanged with each other and are not specifically distinguished with each other. In the specific embodiments, the description is made by taking TFTs as an example.

Figure 6:
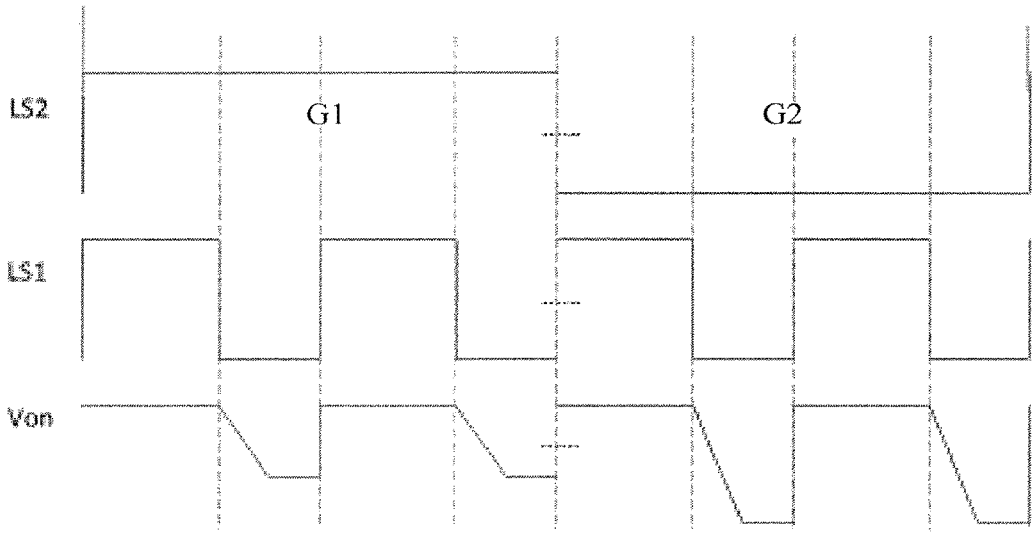
FIG. 6 is an schematic diagram of operating time sequence of the chamfering module provided by the embodiment of the present disclosure.

In the following, the specific scan procedure of the above display panel provided by the embodiment of the present disclosure will be explained by referring to a specific embodiment, in which the explanation is made by taking the circuit structure of the chamfering module shown in FIG. 4 and the structure of the display panel shown in FIG. 5 as an example. The operating time sequence of the circuit of the chamfering module as shown in FIG. 4 is as shown in FIG. 6. Specifically, in the following description, the high-level signal is represented by 1 and the low-level signal is represented by 0.

In the scan phase of the gate drive chip G1, the second output terminal LS2 of the clock control module outputs a high-level signal, that is, LS2=1, and the fifth switching transistor T5 is in a turn-on state. The turn-on fifth switching transistor T5 transfers the shallowly-chamfered voltage signal at its source to the source of the fourth switching transistor T4. The scan signal output by the first output terminal LS1 of the clock control module is consistent with the gate scan signal. Thus, when LS1=1, the first switching transistor T1 and the third switching transistor T3 are in the turn-on state. At this time, the turn-on first switching transistor T1 transfers the high-level signal VGH output by the second output terminal of the voltage generation module to the source of the third switching transistor T3, the turn-on third switching transistor T3 then transfers the high-level signal VGH to the gate turn on voltage input terminal Von, and the high-level signal VGH is in turn output to the gate drive chip G1. The gate drive chip G1 outputs the scan signal to the corresponding gate lines in accordance with the corresponding time sequence. When LS1=0, the second switching transistor T2 and the fourth switching transistor T4 are in the turn-on state, the turn-on fourth switching transistor T4 then transfers the shallowly-chamfered voltage signal at the source of the fifth switching transistor T5 to the gate turn on voltage input terminal Von, and the shallowly-chamfered voltage signal is in turn output to the gate drive chip G1. The gate drive chip G1 outputs the scan signal to the corresponding gate lines in accordance with the corresponding time sequence.

In the scan phase of the gate drive chip G2, the second output terminal LS2 of the clock control module outputs a low-level signal, that is, LS2=0, and the sixth switching transistor T6 is in a turn-on state. The turn-on sixth switching transistor T6 connects the source of the fourth switching transistor T4 with the ground signal terminal GND. The scan signal output by the first output terminal LS1 of the clock control module is consistent with the gate scan signal. Thus, when LS1=1, the first switching transistor T1 and the third switching transistor T3 are in the turn-on state. At this time, the turn-on first switching transistor T1 transfers the high-level signal VGH output by the second output terminal of the voltage generation module to the source of the third switching transistor T3, the turn-on third switching transistor T3 then charges the storage capacitor C to the voltage of VGH and transfers the high-level signal VGH to the gate turn on voltage input terminal Von at the same time, and the high-level signal VGH is in turn output to the gate drive chip G2. The gate drive chip G2 outputs the scan signal to the corresponding gate lines in accordance with the corresponding time sequence. When LS1=0, the second switching transistor T2 and the fourth switching transistor T4 are in the turn-on state, the turn-on fourth switching transistor T4 then connects one end of the storage capacitor C with the ground signal terminal GND via the turn-on sixth switching transistor T6, and subsequently the storage capacitor C is discharged to the ground, so that the gate turn on voltage input terminal Von outputs the deeply-chamfered voltage signal to the gate drive chip G2. The gate drive chip G2 outputs the scan signal to the corresponding gate lines in accordance with the corresponding time sequence.

In this way, since the wiring with which the gate turn on voltage signal is transferred to the gate drive chip G1 is shorter, the shallowly-chamfered gate turn on voltage signal is input to the gate drive chip G1; while since the wiring with which the gate turn on voltage signal is transferred to the gate drive chip G2 is longer, the deeply-chamfered gate turn on voltage signal is input to the gate drive chip G2. The two gate drive chips are input with gate turn on voltage signals of different chamfering depths, which pass though wirings of different lengths, and finally magnitudes of gate scan signals output by the gate drive chip G1 and the gate drive chip G2 terminal tend to be uniform, thus alleviating the phenomenon of horizontal two slip screen and improving the quality of the display screen.

In a specific implementation, in the above display panel provided by the embodiment of the present disclosure, the display panel may includes two groups of gate drive chips which are symmetrically distributed at two terminals of the gate lines, multiple gate drive chips in each group of gate drive chips are connected in cascade, and the gate drive chip of the last stage in the first group of gate drive chips and the gate drive chip of the last stage in the second group of gate drive chips are connected in cascade. The gate turn on voltage compensating circuit is used for inputting the corresponding chamfered gate turn on voltage signal to the gate drive chip of the first stage in the first group of gate drive chips at the chamfering time.

Figure 7:
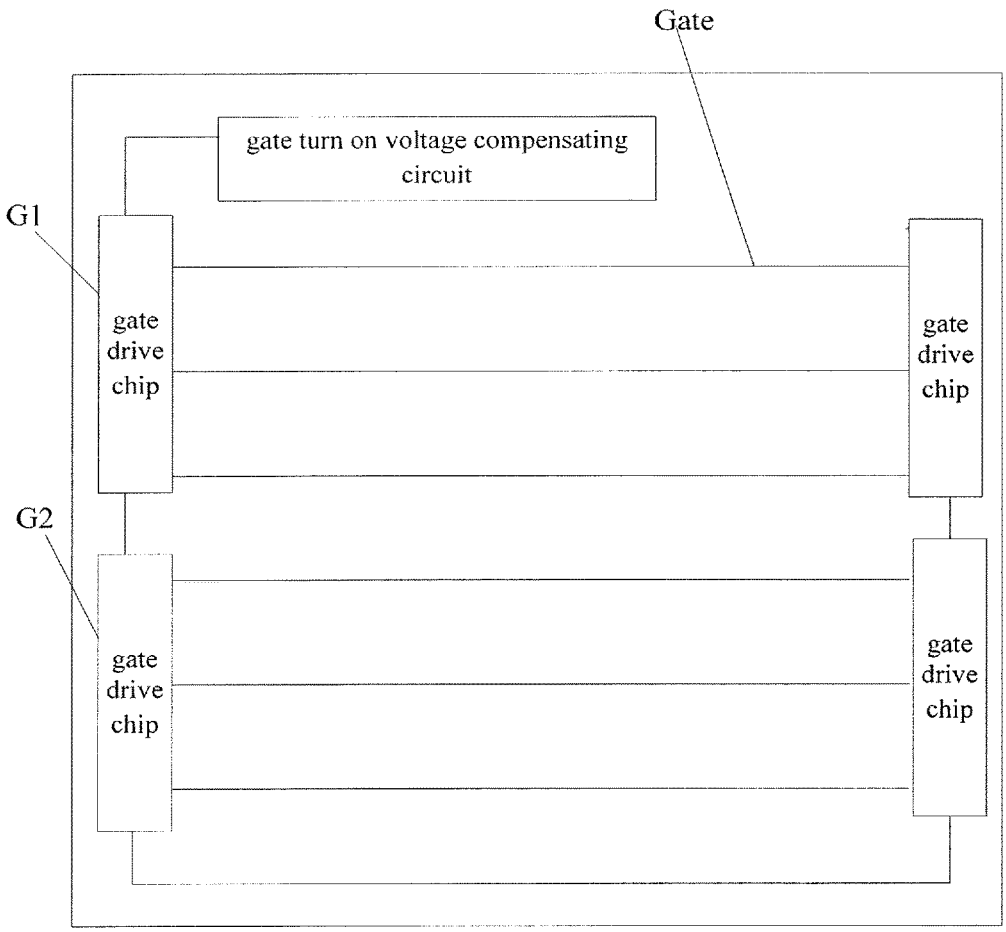
FIG. 7 is a second schematic structure diagram of the display panel provided by the embodiment of the present disclosure.

Specifically, in the above display panel provided by the embodiment of the present disclosure, as shown in FIG. 7, a driving way of bilateral compensation may be employed, that is, two groups of gate drive chips which are bilaterally symmetry are arranged. The gate turn on voltage signal output by the gate turn on voltage compensating circuit is output to the gate drive chip of the first stage of the first group of gate drive chips, and after the bidirectional driving applied by gate drive chips on the two sides, the uniformity of gate scan signals input to respective gate lines may be further improved finally, thus alleviating the phenomenon of horizontal two split screen and improving the quality of the display screen.

Based on the same inventive concept, an embodiment of the present disclosure provides a driving method of the display panel provided by the above embodiment of the present disclosure, which may includes: within the display time of one frame, inputting, by the gate turn on voltage compensating circuit, shallowly-chamfered gate turn on voltage signal to gate drive chips of former m stages in the multiple gate drive chips connected in cascade, and inputting deeply-chamfered gate turn on voltage signals to gate drive chips of remaining stages. Specifically, since respective gate drive chips are connected in cascade in the display panel, the shallowly-chamfered gate turn on voltage signal may be input to gate drive chips of former m stages. Since the wirings of gate turn on voltage signals in the remaining gate drive chips are longer compared with gate drive chips of former m stages, the chamfering depths of gate turn on voltage signals input to the remaining gate drive chips are increased. In this way, gate turn on voltage signals of different chamfering depths reach gate drive chips of respective stages via wirings of different lengths, and finally gate turn on voltage signals, i.e. gate scan signals, output by respective gate drive chips are more uniform, thus alleviating the phenomenon of horizontal two split screen and improving the quality of the display screen.

Based on the same inventive concept, an embodiment of the present disclosure provides a display apparatus including the above display panel provided by the embodiment of the present disclosure. The display apparatus may be any product or means with a display function, such as a mobile phone, a tablet computer, a television set, a display, a notebook computer, a digital photo frame, a navigator and so on. Since the principle by which the display apparatus solves problems is similar with that by the above display panel, the implementation of the display apparatus may refer to the implementation of the above display panel, and the repeated parts will be no longer described for avoiding redundancy.

Apparently, those killed in the art may make various modifications and variations to the present disclosure without departing from the spirit and scope of the present disclosure. In this way, if these modifications and variations of the present disclosure belong to the scope of claims of the present disclosure and equivalent techniques thereof, the present disclosure is intend to contain these modifications and variations.

What is claimed is:

1. A gate turn on voltage compensating circuit, comprising a voltage generation module, a clock control module and a chamfering module, the voltage generation module being used for generating a first voltage signal and a second voltage signal and correspondingly outputting, through a first voltage output terminal and a second voltage output terminal thereof, the generated first and second voltage signals to a first voltage input terminal and a second voltage input terminal of the chamfering module;

a first output terminal of the clock control module being connected with a first control terminal of the chamfering module, a second output terminal of the clock control module being connected with a second control terminal of the chamfering module; and the chamfering module outputting the second voltage signal at a first time period and outputting a chamfered gate turn on voltage signal at a second time period under the control of the first output terminal and the second output terminal of the clock control module based on the first voltage signal and the second voltage signal.

2. The gate turn on voltage compensating circuit according to claim 1, wherein the chamfering module comprises a chamfering time control unit, a chamfering depth control unit and a output control unit, wherein a first control terminal of the chamfering time control unit is connected with the first output terminal of the clock control module, a second control terminal thereof is connected with a reference voltage terminal, a first input terminal thereof is connected with the second voltage output terminal of the voltage generation module, a second input terminal thereof is connected with a ground signal terminal, and an output terminal thereof is connected with a first control terminal and a first input terminal of the output control unit respectively, and the chamfering time control unit is used for controlling the chamfering time for outputting the chamfered gate turn on voltage signal under the control of the first output terminal of the clock control module and the reference voltage terminal;

a first control terminal of the chamfering depth control unit is connected with the second output terminal of the clock control module, a second control terminal thereof is connected with the reference voltage terminal, a first input terminal thereof is connected with the first voltage output terminal of the voltage generation module, a second input terminal thereof is connected with the ground signal terminal, and an output terminal thereof with a second input terminal of the output control unit, and the chamfering depth control unit is used for outputting the chamfered gate turn on voltage signals of different chamfering depths under the control of the second output terminal of the clock control module and the reference voltage terminal;

a second control terminal of the output control unit is connected with the first voltage output terminal of the voltage generation module, a third input terminal thereof is connected with the ground signal terminal, and an output terminal thereof is connected with a gate turn on voltage input terminal, and the output control unit is used for selecting, through the gate turn on voltage input terminal, to output the second voltage signal generated by the voltage generation module or the chamfered gate turn on voltage signal under the control of the output terminal of the chamfering time control unit and the first voltage output terminal of the voltage generation module.

3. The gate turn on voltage compensating circuit according to claim 2, wherein the chamfering time control unit comprises a first comparator, a first switching transistor, a second switching transistor and a first resistor, wherein a first input terminal of the first comparator is connected with the first output terminal of the clock control module, a second input terminal thereof is connected with the reference voltage terminal, and an output terminal thereof is connected with a gate of the first switching transistor and a gate of the second switching transistor, respectively;

a source of the first switching transistor is connected with the second voltage output terminal of the voltage generation module, a drain thereof is connected with a drain of the second switching transistor and the first input terminal of the output control unit, respectively;

a source of the second switching transistor is connected with one end of the first resistor;

the other end of the first resistor is connected with the ground signal terminal.

4. The gate turn on voltage compensating circuit according to claim 3, wherein the first switching transistor is an N-type transistor, and the second switching transistor is a P-type transistor.

5. The gate turn on voltage compensating circuit according to claim 2, wherein the output control unit comprises a second comparator, a third switching transistor, a fourth switching transistor and a storage capacitor, wherein a first input terminal of the second comparator is connected with the output terminal of the chamfering time control unit and a source of the third switching transistor, respectively, a second input terminal thereof is connected with the first voltage output terminal of the voltage generation module, and an output terminal thereof is connected with a gate of the third switching transistor and a gate of the fourth switching transistor, respectively;

a drain of the third switching transistor is connected with the gate turn on voltage input terminal;

a source of the fourth switching transistor is connected with the output terminal of the chamfering depth control unit, and a drain thereof is connected with the gate turn on voltage input terminal;

the storage capacitor is connected between the ground signal terminal and the gate turn on voltage input terminal.

6. The gate turn on voltage compensating circuit according to claim 5, wherein the third switching transistor is an N-type transistor, and the fourth switching transistor is a P-type transistor.

7. The gate turn on voltage compensating circuit according to claim 2, wherein the chamfering depth control unit comprises a second resistor, a third resistor, a third comparator, a fifth switching transistor, a sixth switching transistor and a fourth resistor, wherein one end of the second resistor is connected with the first voltage output terminal of the voltage generation module, and the other end thereof is connected with one end of the third resistor and a source of the fifth switching transistor, respectively;

the other end of the third resistor is connected with the ground signal terminal;

a first input terminal of the third comparator is connected with the second output terminal of the clock control module, a second input terminal thereof is connected with the reference voltage terminal, and an output terminal thereof is connected with a gate of the fifth switching transistor and a gate of the sixth switching transistor, respectively;

a drain of the fifth switching transistor is connected with a drain of the sixth switching transistor and the second input terminal of the output control unit, respectively;

a source of the sixth switching transistor is connected with one end of the fourth resistor;

the other end of the fourth resistor is connected with the ground signal terminal.

8. The gate turn on voltage compensating circuit according to claim 7, wherein the fifth switching transistor is an N-type transistor, and the sixth switching transistor is a P-type transistor.

9. The gate turn on voltage compensating circuit according to claim 1, wherein the gate turn on voltage compensating circuit is arranged on a printed circuit board.

10. A display panel, comprising a plurality of gate lines located in a display area, a plurality of gate drive chips for inputting gate turn on voltage signals to the gate lines, and the gate turn on voltage compensating circuit according to claim 1, wherein the gate drive chips are connected in cascade;

the gate turn on voltage compensating circuit is used for inputting the corresponding chamfered gate turn on voltage signal to the gate drive chip of a first stage at the chamfering time.

11. The display panel according to claim 10, wherein the plurality of gate drive chips forms two groups of gate drive chips which are symmetrically distributed at two terminals of the gate lines, and the gate drive chip of the last stage in the first group of gate drive chips and the gate drive chip of the last stage in the second group of gate drive chips are connected in cascade;

the gate turn on voltage compensating circuit is used for inputting the corresponding chamfered gate turn on voltage signal to the gate drive chip of the first stage in the first group of gate drive chips at the chamfering time.

12. The display panel according to claim 11, wherein the chamfering module comprises a chamfering time control unit, a chamfering depth control unit and a output control unit, wherein a first control terminal of the chamfering time control unit is connected with the first output terminal of the clock control module, a second control terminal thereof is connected with a reference voltage terminal, a first input terminal thereof is connected with the second voltage output terminal of the voltage generation module, a second input terminal thereof is connected with a ground signal terminal, and an output terminal thereof is connected with a first control terminal and a first input terminal of the output control unit respectively, and the chamfering time control unit is used for controlling the chamfering time for outputting the chamfered gate turn on voltage signal under the control of the first output terminal of the clock control module and the reference voltage terminal;

a first control terminal of the chamfering depth control unit is connected with the second output terminal of the clock control module, a second control terminal thereof is connected with the reference voltage terminal, a first input terminal thereof is connected with the first voltage output terminal of the voltage generation module, a second input terminal thereof is connected with the ground signal terminal, and an output terminal thereof with a second input terminal of the output control unit, and the chamfering depth control unit is used for outputting the chamfered gate turn on voltage signals of different chamfering depths under the control of the second output terminal of the clock control module and the reference voltage terminal;

a second control terminal of the output control unit is connected with the first voltage output terminal of the voltage generation module, a third input terminal thereof is connected with the ground signal terminal, and an output terminal thereof is connected with a gate turn on voltage input terminal, and the output control unit is used for selecting, through the gate turn on voltage input terminal, to output the second voltage signal generated by the voltage generation module or the chamfered gate turn on voltage signal under the control of the output terminal of the chamfering time control unit and the first voltage output terminal of the voltage generation module.

13. The display panel according to claim 12, wherein the chamfering time control unit comprises a first comparator, a first switching transistor, a second switching transistor and a first resistor, wherein a first input terminal of the first comparator is connected with the first output terminal of the clock control module, a second input terminal thereof is connected with the reference voltage terminal, and an output terminal thereof is connected with a gate of the first switching transistor and a gate of the second switching transistor, respectively;

a source of the first switching transistor is connected with the second voltage output terminal of the voltage generation module, a drain thereof is connected with a drain of the second switching transistor and the first input terminal of the output control unit, respectively;

a source of the second switching transistor is connected with one end of the first resistor;

the other end of the first resistor is connected with the ground signal terminal.

14. The display panel according to claim 13, wherein the first switching transistor is an N-type transistor, and the second switching transistor is a P-type transistor.

15. The display panel according to claim 12, wherein the output control unit comprises a second comparator, a third switching transistor, a fourth switching transistor and a storage capacitor, wherein a first input terminal of the second comparator is connected with the output terminal of the chamfering time control unit and a source of the third switching transistor, respectively, a second input terminal thereof is connected with the first voltage output terminal of the voltage generation module, and an output terminal thereof is connected with a gate of the third switching transistor and a gate of the fourth switching transistor, respectively;

a drain of the third switching transistor is connected with the gate turn on voltage input terminal;

a source of the fourth switching transistor is connected with the output terminal of the chamfering depth control unit, and a drain thereof is connected with the gate turn on voltage input terminal;

the storage capacitor is connected between the ground signal terminal and the gate turn on voltage input terminal.

16. The display panel according to claim 15, wherein the third switching transistor is an N-type transistor, and the fourth switching transistor is a P-type transistor.

17. The display panel according to claim 12, wherein the chamfering depth control unit specifically comprises a second resistor, a third resistor, a third comparator, a fifth switching transistor, a sixth switching transistor and a fourth resistor, wherein one end of the second resistor is connected with the first voltage output terminal of the voltage generation module, and the other end thereof is connected with one end of the third resistor and a source of the fifth switching transistor, respectively;

the other end of the third resistor is connected with the ground signal terminal;

a first input terminal of the third comparator is connected with the second output terminal of the clock control module, a second input terminal thereof is connected with the reference voltage terminal, and an output terminal thereof is connected with a gate of the fifth switching transistor and a gate of the sixth switching transistor, respectively;

a drain of the fifth switching transistor is connected with a drain of the sixth switching transistor and the second input terminal of the output control unit, respectively;

a source of the sixth switching transistor is connected with one end of the fourth resistor;

the other end of the fourth resistor is connected with the ground signal terminal.

18. The display panel according to claim 17, wherein the fifth switching transistor is an N-type transistor, and the sixth switching transistor is a P-type transistor.

19. A driving method of the display panel according to claim 10, comprising:

within the display time of one frame, inputting, by the gate turn on voltage compensating circuit, shallowly-chamfered gate turn on voltage signals to gate drive chips of former m stages in the plurality of gate drive chips connected in cascade, and inputting deeply-chamfered gate turn on voltage signals to gate drive chips of remaining stages.

20. A display apparatus, comprising the display panel according to claim 10.

* * * * *